United States Patent [19]

Boucherie

[11] Patent Number: 4,968,102

[45] Date of Patent: Nov. 6, 1990

[54] DEVICE FOR THE FIBER SUPPLY TO A FILLING MACHINE OF A BRUSH MANUFACTURING MACHINE

[75] Inventor: Leonel Boucherie, Roeselare-Rumbeke, Belgium

[73] Assignee: Firma G. B. Boucherie, Naamloze Vennootschap, Izegem, Belgium

[21] Appl. No.: 363,722

[22] Filed: Jun. 9, 1989

[30] Foreign Application Priority Data

Jun. 17, 1988 [BE] Belgium ..... 8800692

[51] Int. Cl.[5] ..... A46D 1/08

[52] U.S. Cl. ..... 300/7

[58] Field of Search ..... 300/2–11, 300/21

[56] References Cited

U.S. PATENT DOCUMENTS 4,733,917 3/1988 Boucherie ..... 300/7

*Primary Examiner*—Mark Rosenbaum

*Attorney, Agent, or Firm*—Foley & Lardner, Schwartz, Jeffery, Schwaab, Mack, Blumenthal & Evans

[57] ABSTRACT

Improved device for the supply of fibers to a filling machine of a brush manufacturing machine of the type which mainly consists in a drawer (4) movable between a fixed multiple fiber container (1) and a pick-up device (5), in which this drawer (4) consists in a number of relatively small loading spaces (2,3), which act as locks for the moving of the fibers (6, 7, 14, 15) out of the fiber channels (8, 9) of aforementioned fiber container (1) to the cluster pick-up device (5), characterized in that the loading spaces (2, 3) are of such shape that regardless of their position a connection remains with the subject fiber channel (8), respectively (9).

4 Claims, 2 Drawing Sheets

Fig. 3
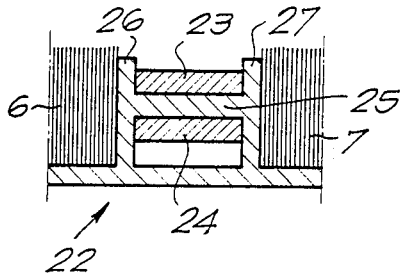
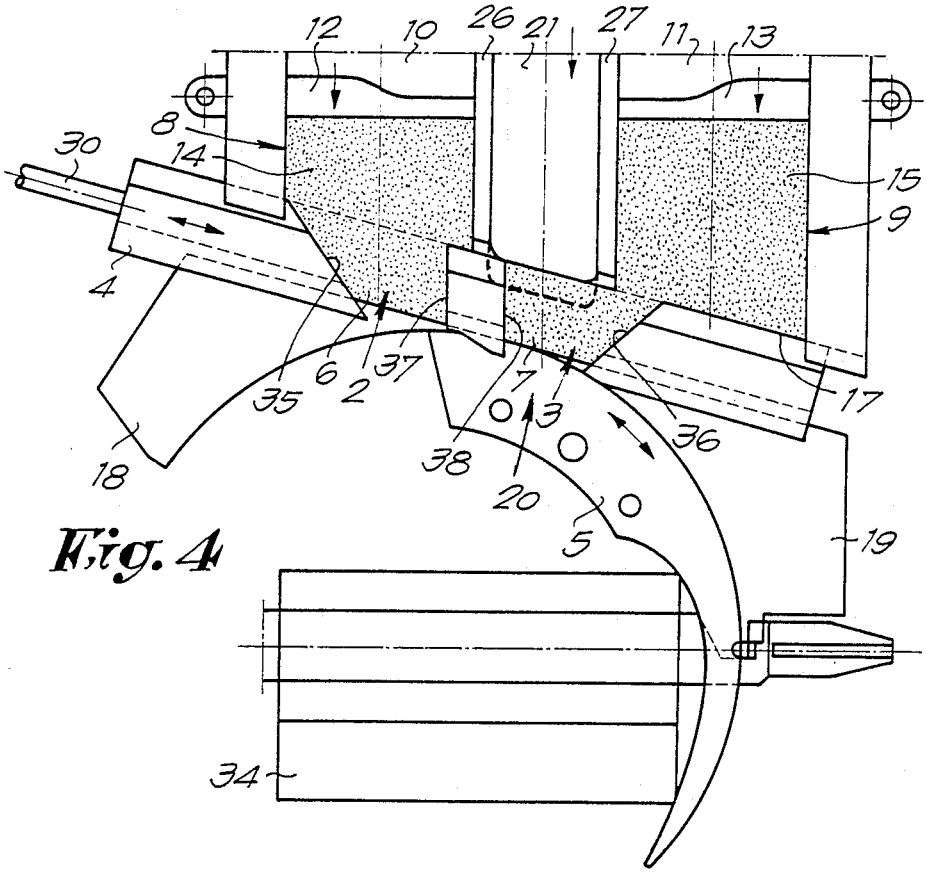
Fig. 4

DEVICE FOR THE FIBER SUPPLY TO A FILLING MACHINE OF A BRUSH MANUFACTURING MACHINE

BACKGROUND OF THE INVENTION

1. Field of the Invention

The present invention concerns an improved device for the supply of fibers to a filling machine of a brush manufacturing machine.

2. Discussion of the Related Art

From the Belgian Patent No. 902.770 a device is known of the model in which from a multiple fiber container, respectively from different fiber channels thereof, by means of a cluster pick-up device, various kinds of fibers can be removed in order to lead them in an appropriate way to a filling machine.

This known device mainly consists of a drawer which is provided for in a movable manner between a fixed multiple fiber container and a pick-up device, this drawer consisting in a number of small loading spaces which serve as a lock for the transfer of the fibers from the fiber channels of aforementioned fiber container to the cluster pick-up device.

Even though this known device generally is satisfactory, it has been experienced that for particular kinds of fibers, such as for instance long fibers, so-called crimped fibers, natural fibers and the like, problems arise due to the separation of the fiber channel as such from the loading space by means of the aforementioned drawer by which, below the pushing element which pushes the fibers which are brought to the lock or loading space to the cluster pick-up device, after a number of back and forth movements of the aforementioned drawer, a fiber clew appears which can not be caught by the bundle pick-up device resulting in an irregular filling of the brushes.

SUMMARY OF THE INVENTION

With the aim to exclude this unwanted accumulation of fibers, one has, according to present invention, developed that each lock is provided in the aforementioned drawer, in such way that, when it is located underneath the aforementioned pushing device to allow the cluster pick-up device to carry fibers along from the lock, a connection remains between the concerned fiber channel and the corresponding lock or loading space.

Indeed, in this way one achieves that the aforementioned separation between the fiber channel and subject lock, which has led to an accumulation of fibers in some cases, is no longer present thereby avoiding such an accumulation.

BRIEF DESCRIPTION OF THE DRAWINGS

In order to better show the characteristics of present invention, as an example and without any restrictive character, a pair of preferable embodiments are described hereafter with reference to the enclosed drawings, in which:

FIGS. 2 and 3 respectively show a cross section according to lines II—II and III—III in FIG. 1; and FIG. 4 shows a view similar to that of FIG. 1. but for a variant of the embodiment.

DETAILED DESCRIPTION OF THE PREFERRED EMBODIMENTS

Figure 1:
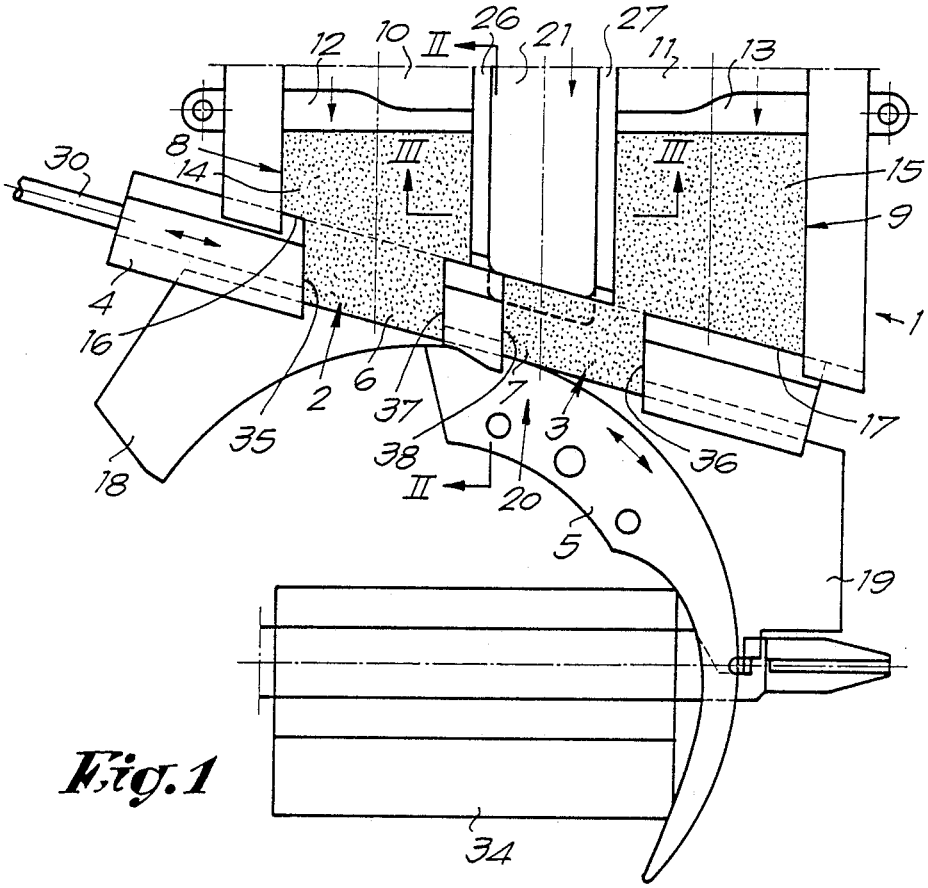
FIG. 1 is a top view of a device according to the invention.

As shown in FIG. 1, the device for the supply of fibers mainly consists the combination of a multiple fiber container 1; a drawer 4 provided with loading spaces or locks 2–3; an oscillating cluster pick-up device 5 which operates along the drawer 4; means to push out of one of the loading spaces 2–3 the fibers 6–7 it contains to the cluster pick-up device 5 and means to drive the drawer 4.

The fiber container 1 in the shown embodiment consists of two fiber channels 8–9 which are equipped, at their filling extremities 10–11, with pushing means 12–13 to push the fibers 14–15, which more often are of different types, residing in the fiber channels to the discharge extremities, 16 and 17 respectively, of the fiber channels 8 and 9.

The drawer 4 operates mainly on the same plane as the fiber container 1 and is movable sideways along the discharge extremities 16–17 of latter. At its other side the drawer 4 slides along guides 18–19 limiting a discharge opening 20 and acting as fiber separators. Drawer 4 can slide in such way that alternatively, on the one hand, each loading space 2–3 of it can be placed in front of a determined fiber channel providing in the filling thereof and, on the other hand, each loading space 2–3 containing the fibers as desired to be located in front of the discharge opening 20 of the cluster pick-up device.

Figure 2:
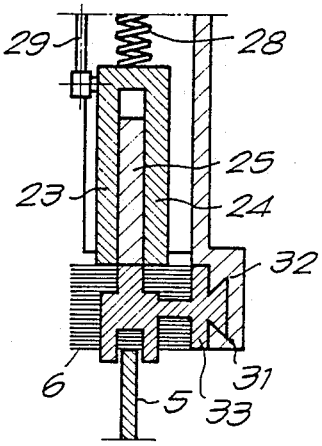

Aforementioned means to push the fibers 6–7 out of one of the loading spaces 2–3 against the cluster pick-up device 5, as shown in FIG. 2, are formed by a pushing element 21 located across the discharge opening 20. In the represented embodiment, this pushing element 21 is placed in the separation wall 22 between two fiber channels 8 and 9 and is formed in a U-shape, in which the legs 23 and 24 of the U-shape are slidable over an intermediate piece 25 whose corners, contacting the drawer 4 are sharp-edged in order to ensure a clean separation of the fibers and between guides 26–27. The pushing element 21 can, for instance, be formed by a spring 28 and possibly a return mechanism 29.

The means to drive the drawer 4 are preferably formed by a cam lever mechanism or by a controlled pneumatic propulsion of which the driveshaft 30 only is represented in FIG. 1.

The drawer 4 is obviously provided with the required longitudinal guides 31–32 to ensure a smooth operation. Preferably, the bottom 33 located underneath the loading spaces 2–3 is slidable together with the drawer 4 and shall as such form a unit herewith.

The cluster pick-up device 5, which is connected in a known fashion with a filling machine 34 is, in the shown embodiment, of the half moon type, but it can also be of the straight type. Conversely, it is also possible that the cluster pick-up device 5 as well as the drawer 4 are of a circular shape.

As it appears in. FIG. 1, the loading spaces 2–3 possess, according to the present invention, such a width that, when the drawer 4 has brought fibers from a particular channel 8 or 9 underneath the pushing element 21, the fibers from that particular channel remain in connection with the fibers in the matching loading space, in such way that in no possible way can fibers engage themselves between the walls 35, and 36, of the loading spaces 2 and 3, on the one hand, and a corresponding intermediate piece 25, on the other hand, since these do not touch one another.

The operation of the embodiment according to the invention can simply be deduced from the drawings and is as follows.

The pushing means 12 and 13 in the fiber channels 8 and 9 push the fibers 14 and 15 against the drawer 4. In this way, the loading space 2 or 3, adjoining one of the fiber channels 8 or 9 is filled with the concerned fibers 14 or 15. Meanwhile, the cluster pick-up device 5 extracts fibers from the loading space 2 or 3 located in front of the pushing element 21. The pushing element 21 thus ensures a constant pressure on the concerned fibers 6 or 7.

When changing one kind of fibers for another, for instance from fibers 15 to fibers 14, the drawer 4 shown in FIG. 1 is moved to the right in such way that the loading space 2 on the left is placed in front of the discharge opening 20, in which a continuous connection is maintained between channel 8 and loading space 2. At the same time the loading space 3 on the right locates itself in front of the fiber channel 9 on the right, and is being filled up as required with fibers 15.

In FIG. 4, finally, it is shown that the walls 35 and 36 do not necessarily have to be parallel to the walls 37 and 38 of the loading spaces 2 and 3, but can be formed at an angle in which the opening of the loading spaces 2 and 3, located against the cluster pick-up device 5, can be kept as small as possible.

It is obvious that walls 35–36 as well as walls 37–38 can converge toward the cluster pick-up device 5.

It is evident that present invention is not limited to the embodiments described in the examples and shown in the enclosed drawings, but that a device according to the invention can be provided for in all forms and dimensions without leaving the scope of the invention.

I claim:

1. An apparatus for loading a supply of fiber into the removal opening of the bundle remover of a filling tool of a brush manufacturing machine comprising:

a fiber magazine having a plurality of fiber channels for holding several units of fiber and having a discharge end;

means for removing one unit of fiber from the fiber magazine, said removing means comprising a slide reciprocally moveable between the discharge end of the fiber magazine and the removal opening of the bundle remover and having a plurality of loading spaces, each loading space being adapted to receive a unit of fiber and being arranged and shaped so that at least a portion of each of said loading spaces is always in communication with a fiber channel, regardless of the position, relative to the fiber channels, of the slide carrying the loading spaces; and means for inserting each removed unit of fiber into the removal opening of the bundle remover.

2. The apparatus according to claim 1, wherein said loading spaces are bounded by walls which are parallel to each other and parallel to a longitudinal axis of the fiber channels.

3. The apparatus according to claim 1, wherein said loading spaces are bounded by walls which form an angle with respect to each other.

4. The apparatus according to claim 1, wherein said loading spaces are bounded by walls, at least two of which are parallel to a longitudinal axis of the fiber, said two walls for each loading space converging towards said bundle remover.

* * * * *